United States Patent [19]

Lof

[11] Patent Number: 4,817,741

[45] Date of Patent: Apr. 4, 1989

[54] ROTARY DRILL

[75] Inventor: Uno Lof, Sunne, Sweden

[73] Assignee: Lovab, Lof Och Ostlund, AB, Sunne, Sweden

[21] Appl. No.: 103,655

[22] Filed: Oct. 2, 1987

[30] Foreign Application Priority Data

Oct. 3, 1986 [SE] Sweden ..... 8604207

[51] Int. Cl.[4] ..... E21B 10/66

[52] U.S. Cl. ..... 175/398; 175/415

[58] Field of Search ..... 175/327, 392, 398, 399, 175/400, 406, 407, 415

[56] References Cited

FOREIGN PATENT DOCUMENTS

| | | | |
|---|---|---|---|
| 3338577 | 4/1984 | Fed. Rep. of Germany | 175/415 |
| 244986 | 6/1969 | U.S.S.R. | 175/415 |
| 1033693 | 8/1983 | U.S.S.R. | 175/415 |
| 2031481 | 4/1980 | United Kingdom | 175/398 |

*Primary Examiner*—Jerome W. Massie, IV
*Assistant Examiner*—David J. Bagnell
*Attorney, Agent, or Firm*—Dennison, Meserole, Pollack & Scheiner

[57] ABSTRACT

The invention relates to a simplified and reliably functioning drill tool for a sinker drill for drilling in loose earth, such as when reinforcing the foundations in connection with building. The drill tool according to the present invention is in two parts and consists of an upper cylindrical transition piece (1), its central coinciding with the rotary axis of the drill tool, and provided withan eccentric, cylindrical hole (4), and of a lower reamer piece (2) provided with an upwardly directed shaft (3) to fit into the hole. In operating position the shaft (b 3) is fully inserted into the hole (4) and the transition piece (1) and reamer piece (b 2) cooperate. In extraction position the shaft (3) is partially withdrawn from the hole (4) to permit the drill (1,2) to be drawn up through a casing-tube.

5 Claims, 7 Drawing Sheets

ROTARY DRILL

BACKGROUND OF THE INVENTION

The present invention relates to a drill with reamer piece for a sinker drill.

Such drills are carried by a drill rod and accompanied by a casing-tube down into the drill hole. Drill cutting chippings are removed by flushing medium supplied to the drill through a channel in the drill rod. The drill is influenced by a hammer and also by rotation through the drill rod.

There are many designs of drills of this type for boring in both solid and loose ground.

When reinforcing the foundations for building purposes, the intention is that the ground shall not shift, so as to avoid cracks occurring in the buildings. When drilling with sinker drills this can be achieved by using a casing-tube to grout concrete pillars, at the same time filling any ground fissures with concrete. The ground surface can also be prepared by laying a horizontal surface to avoid displacements in the reinforcements.

However, conventional tools for each drilling are expensive and also easily fall apart in use.

SUMMARY OF THE INVENTION

The object of the present invention is to provide an inexpensive and reliable drill comprising a reamer piece and a substantially cylindrical transition piece. This is achieved in practice by the central axis of the transition piece being made to coincide with the rotary axis of the drill rod and being provided with an eccentric, cylindrical hole, the central axis of the hole lying substantially parallel to the rotary axis of the drill rod, and the reamer piece being provided with a shaft to fit into the cylindrical hole, the axial length of the shaft substantially agreeing with the axial depth of the cylindrical hole, wherein the reamer piece with the shaft is axially movable in relation to the transition piece between an operating position an extraction position between which two positions the reamer piece assumes a swung-in position.

BRIEF DESCRIPTION OF THE DRAWINGS

Other features of the invention are defined in the following claims.

One embodiment of the invention will be described below by way of example, with reference to the accompanying drawings in which.

DESCRIPTION OF THE PREFERRED EMBODIMENT

Figure 1:
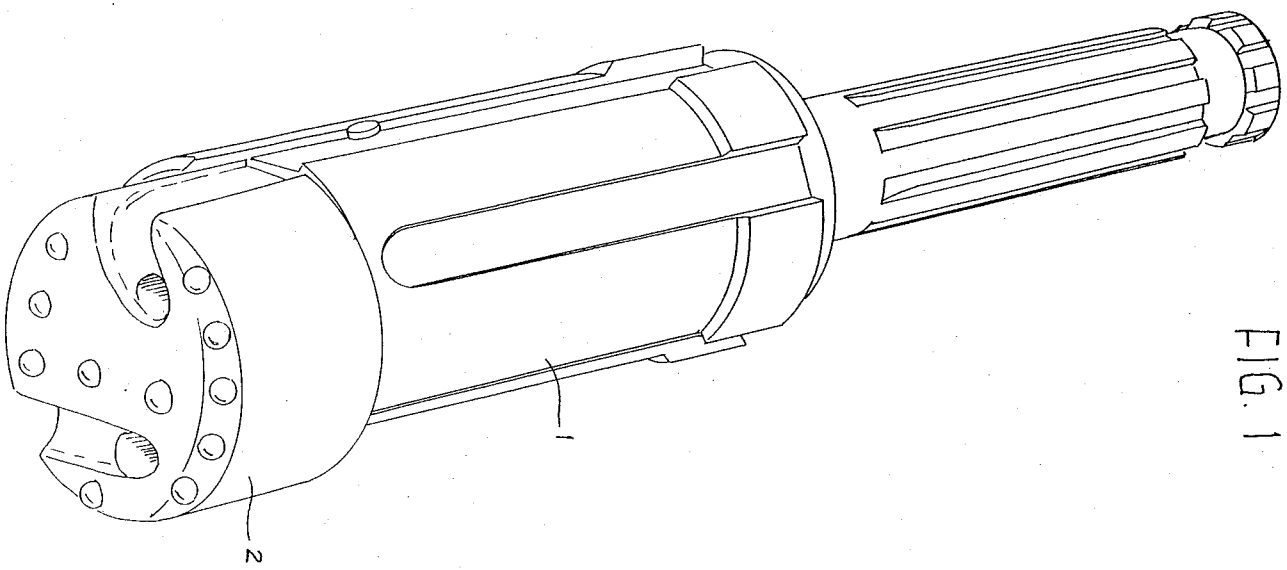
FIG. 1 shows a drill according to the invention.
Figure 2A:
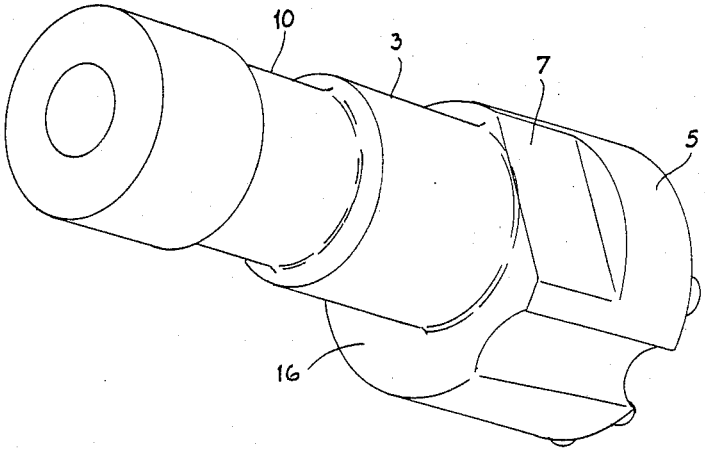
FIGS. 2A and 2B show a reamer piece according to the invention.
Figure 2B:
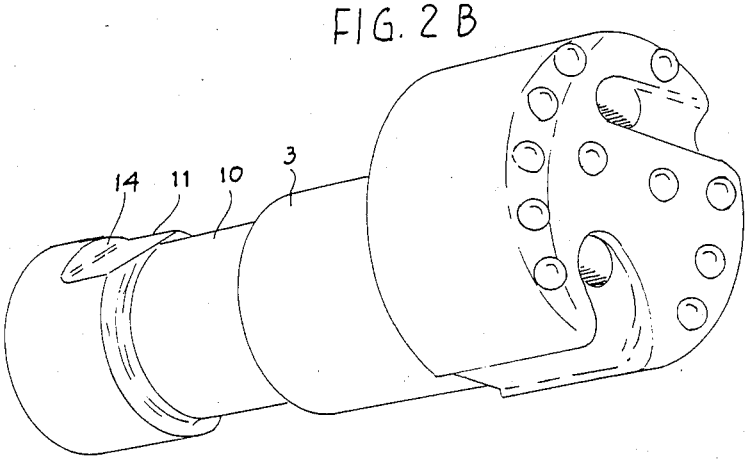
Figure 3A:
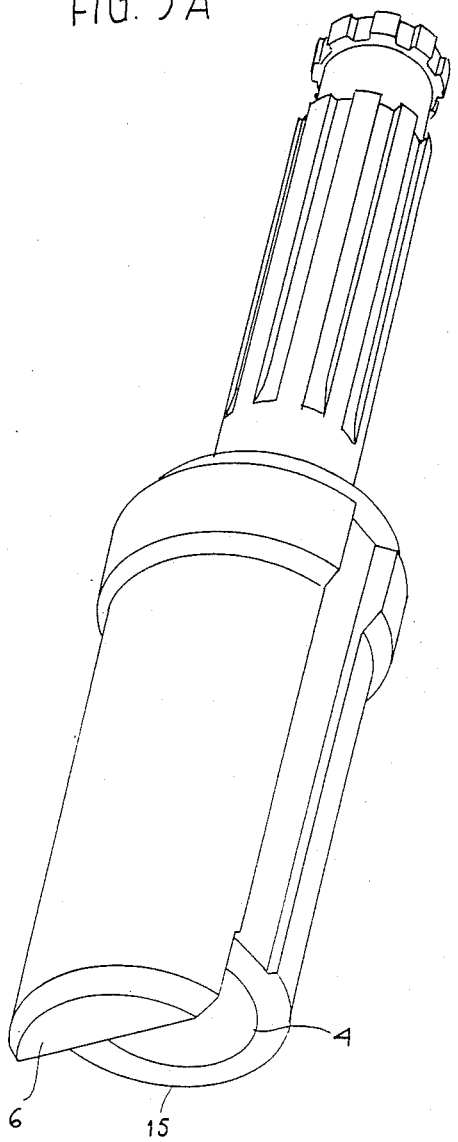
FIGS. 3A and 3B show a transition piece according to the invention.
Figure 3B:
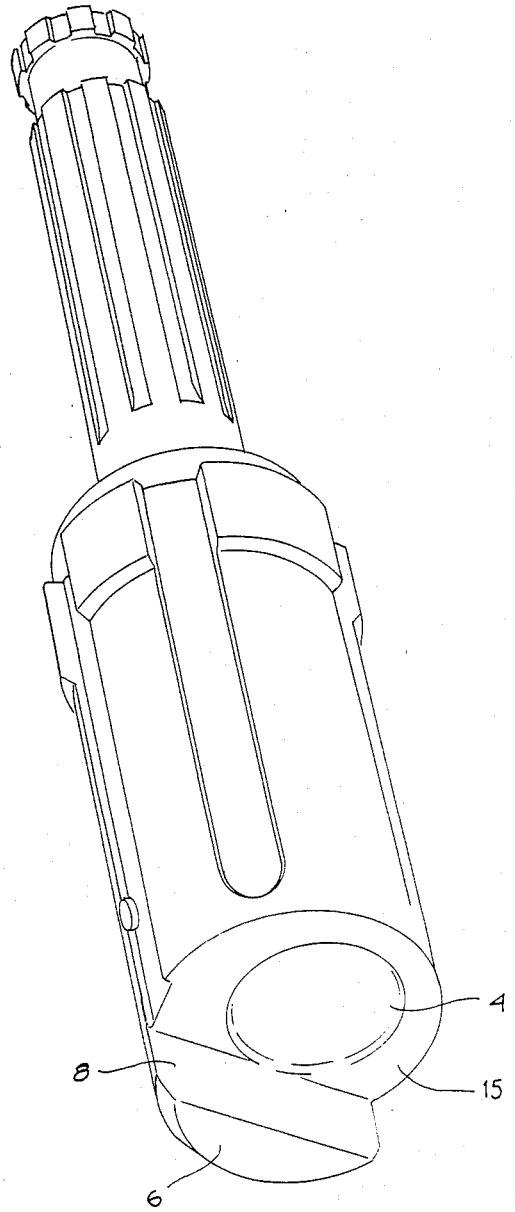

The drill comprises a cylindrical transition piece 1 and a reamer piece 2 provided with hard metal cutting edges or pins arranged in substantially one plane. The transition piece 1 is secured in any suitable manner to a drill rod (not shown). The central axis of the transition piece coincides with the axis of rotation of the drill rod. An eccentric hole 4 is provided at the flat lower side of the transition piece 1, as well as a shoulder 6 having an inwardly facing flat, axial surface 8 made in one piece with the rest of the transition piece. In a plane opposite the hard metal cutting edges, the reamer piece 2 is provided with an eccentric shaft 3 for insertion into the hole 4. The axial length of the shaft 3 corresponds to the axial depth of the hole 4. The surface of the reamer piece 2 has an outwardly directed shoulder 5 cooperating with the shoulder 6 on the transition piece during drilling. The surface 8 of the transition piece also cooperates with a surface 7 on the reamer piece, this latter surface extending axially from the shoulder 5 to the plane in which the shaft 3 is arranged. The shaft 3 is provided with a narrowed waist 10, the axial depth thereof substantially corresponding to or slightly exceedig the axial length of the shoulder 6. Along part of the surface of the shaft, the waist 10 is provided with an upward extension 11 towards the free end of the shaft, thus forming a shoulder 14 at the transition between waist extension 11 and shaft surface.

Figure 4:
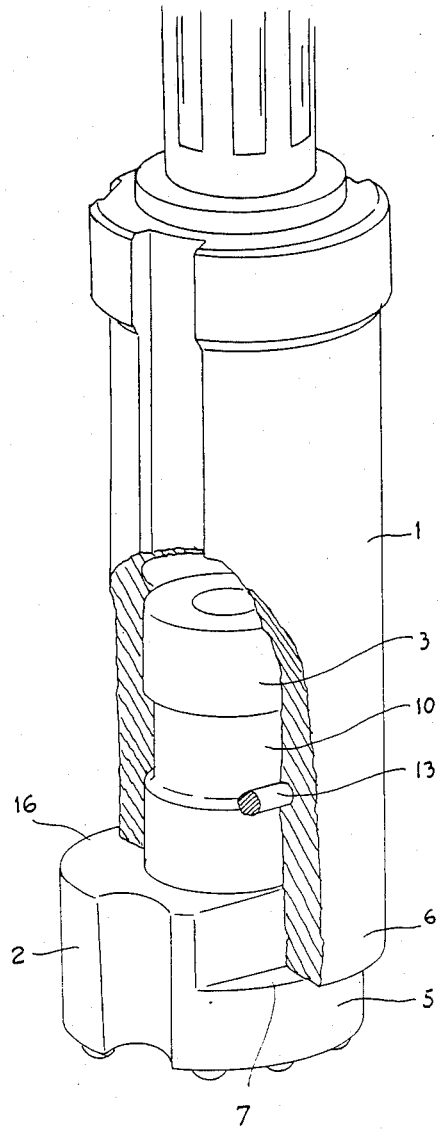
FIG. 4 shows the drill in operating position.

FIG. 4 shows the drill in an operating position. The free end of the shaft 3 is in contact with the bottom of the hole 4 in transition piece 1. The shoulders 5 and 6 of the reamer piece 2 and transition piece 1 also cooperate and a flat edge 15 on the lower end of transition piece 1 is in contact with a flat peripheral edge 16 on the upper end of the reamer piece 2. A pin 13 is inserted through an aperture in the wall of the wall transition piece, into the space defined by the narrowed waist 10 and the hole 4. In the operating position the pin moves freely and is not subjected to any stress. In this position the transition piece 1 and reamer piece 2 rotate together at the same speed as the drill rod. The hammer strikes in two planes, i.e. the plane defined by the upper end of the shaft and the bottom of the hole and the plane defined by the flat peripheral edge 15 and the flat peripheral edge 16. The reamer piece is swung out in the usual manner below the casing-tube, not shown.

Figure 5:
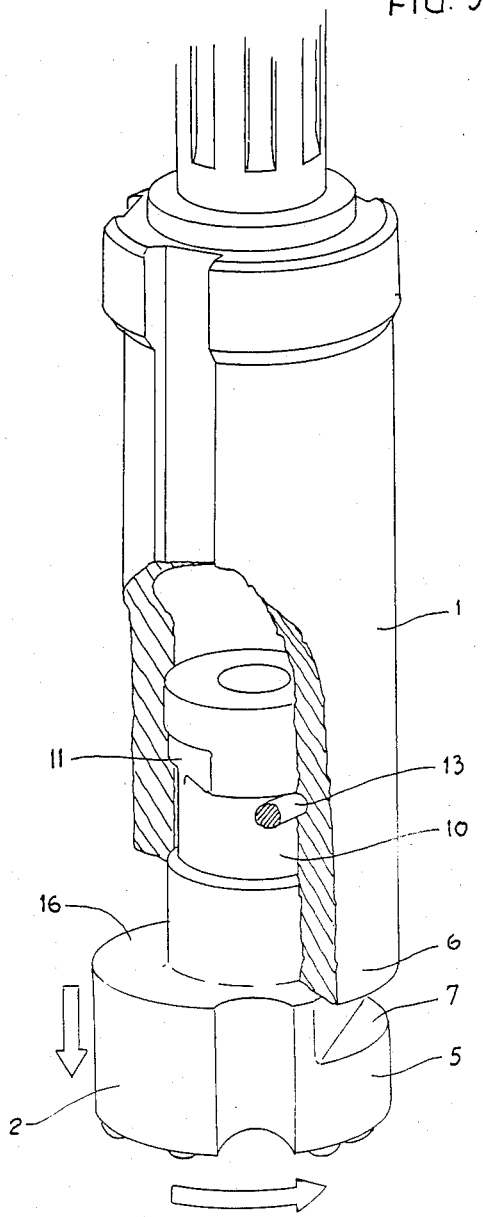
FIG. 5 shows the drill in swung-in position.
Figure 6:
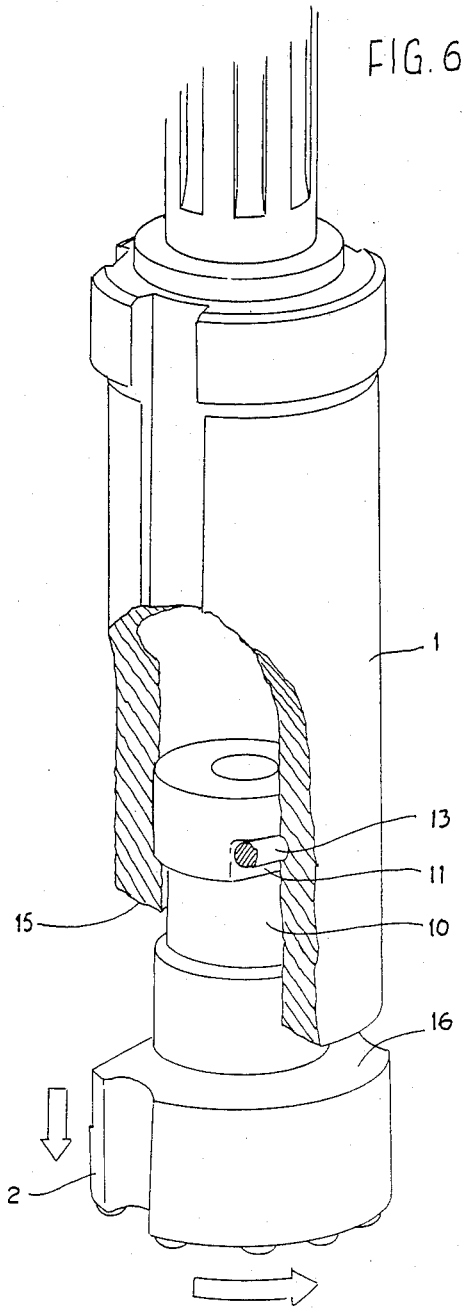
FIG. 6 shows the drill in extraction position.

Extraction of the drill bit is shown in FIGS. 5 and 6, and can now be effected without interrupting or reversing the rotary movement. The drill rod, with the transition piece attached, is raised and when it has been raised a distance corresponding to the axial length of the waist and that of the shoulder 6, the reamer shoulder 5 will be disengaged from the transition-piece shoulder 6. The reamer piece will then rotate to axial alignment with the transition piece and the accompanying casing-tube, not shown, thus permitting the latter to be extracted. In the position the reamer piece is further axially displaced in relation to the transition piece since the pin enters the extension 11 in the waist. This axial displacement continues until the pin is stopped by the shoulder 14. Extraction continues as the pin locks the reamer piece in the hole of the transition piece. The outer diameter of the shaft is preferably somewhat smaller than the diameter of the holder, so that a cylindrical space is formed between shaft and hole.

The invention permits the reamer piece to be swung in without alteration of the direction of rotation. Furthermore, the drill can be operated in any desired direction of rotation.

Extraction is facilitated by blowing clean the shoulder system 5, 6 by means of the flushing fluid supplied to the drill.

The casing-tube, or an impact shoe provided at the lower end of the casing-tube, also has a storage function during reamer drilling according to the invention.

I claim:

1. A rotary boring drill for operation with a casing wherein said boring drill is expanded below the casing for a boring operation and contracted for subsequent removal through the casing, said boring drill comprising a substantially cylindrical transition piece having means at one end for attachment to a rotary and reciprocating drill rod, the central axis of said cylindrical transition piece coinciding with the rotary axis of said drill rod, a planar surface extending over a major portion of the other end of said cylindrical transition piece, a cylindrical hole in said planar surface having an axis spaced from said central axis and extending into said cylindrical transition piece, a driving shoulder integral with an arcuate portion of said cylindrical transition piece at said other end and extending below said planar surface, said driving shoulder having a planar driving surface, a substantially cylindrical reamer piece having a mounting shaft on one end and a cutting surface on the other end, a recessed driven shoulder in an arcuate portion of said cylindrical reamer piece, said driven shoulder having a planar driven surface similar to said planar driving surface, said reamer piece mounting shaft having a portion of reduced diameter and being receivable in said hole in said cylindrical transition piece for rotary and axially reciprocating motion, a pin insertable through a passageway in said cylindrical transition piece and receivable in said reduced diameter portion of said reamer mounting shaft, said pin defining first and second limiting positions of axial motion of said reamer mounting shaft, said pin in said first limiting position residing near the bottom of the reduced portion of said reamer mounting shaft whereby said driver and driven planar surfaces are overlapped and said reamer piece and transition piece are in abutting relationship, said pin in said second limiting position residing near the top portion of said reduced portion of said reamer mounting shaft whereby said driver and driven planar surfaces are decoupled and said transition piece and reamer piece are capable of independent rotation.

2. A rotary boring drill as claimed in claim 1 wherein said reamer piece mounting shaft is eccentrically situated on said reamer piece and when said pin is in said first limiting position with said driver and driven planar surfaces in overlapped relation said boring drill is in an expanded position capable of boring rotation in either direction.

3. A rotary boring drill as claimed in claim 1 wherein an upper portion of said reamer piece mounting shaft is provided with an indexing recess in communication with said reduced diameter portion to lock said pin in said second limiting position whereby said transition and reamer pieces are indexed to present a minimum projected area conducive to the boring drill being withdrawn through the casing.

4. A rotary boring drill as claimed in claim 1 wherein the axial length of the reduced portion of said reamer piece mounting shaft slightly exceeds the axial length of said planar driving surface to enable the decoupling of the transition and reamer pieces when said drill rod is raised.

5. A rotary boring drill as claimed in claim 1 wherein said transition piece and said reamer piece are provided with planar abutting surfaces to absorb mechanical shocks transmitted by the drill rod.

* * * * *